US008038311B2

(12) United States Patent
Lau

(10) Patent No.: US 8,038,311 B2
(45) Date of Patent: Oct. 18, 2011

(54) LED UTILITY LIGHT

(76) Inventor: Chi Hung Fermi Lau, Kowloon (HK)

( * ) Notice: Subject to any disclaimer, the term of this patent is extended or adjusted under 35 U.S.C. 154(b) by 214 days.

(21) Appl. No.: 12/383,533

(22) Filed: Mar. 24, 2009

(65) Prior Publication Data

US 2010/0177502 A1 Jul. 15, 2010

Related U.S. Application Data

(60) Provisional application No. 61/204,981, filed on Jan. 12, 2009.

(51) Int. Cl.
*F21V 21/084* (2006.01)

(52) U.S. Cl. ..... 362/105; 362/157; 362/167; 362/235; 362/800; 362/171

(58) Field of Classification Search ..... 362/239, 362/235, 105, 157, 167, 168, 171, 174, 640, 362/646, 800
See application file for complete search history.

(56) References Cited

U.S. PATENT DOCUMENTS 6,736,529 B1 * 5/2004 Lee ..... 362/287
7,568,812 B1 * 8/2009 Kumthampinij et al. ..... 362/105

* cited by examiner

*Primary Examiner* — Anabel Ton
(74) *Attorney, Agent, or Firm* — Raymond Y. Chan; David and Raymond Patent Firm

(57) ABSTRACT

A LED utility light includes a light head and a light head carrier for supporting the light head, wherein the light head has a light housing, a power source, and a LED light arrangement. The light arrangement includes at lest a light source provided within the light housing, wherein the light head is rotatably and detachably coupling with the light head carrier, so that light source having different light effects is selectively and rotatably adjusted by rotating the light head.

14 Claims, 15 Drawing Sheets

LED UTILITY LIGHT

CROSS REFERENCE OF RELATED APPLICATION

This is a non-provisional application of a provisional application having an application No. 61/204,981 and a filing date of Jan. 12, 2009.

BACKGROUND OF THE PRESENT INVENTION

1. Field of Invention

The present invention relates to a utility light, and more particularly to a LED utility light, which comprises at least a light source having different light effects received in a single light housing such that the user is able to adjustably select the desired light effect for illumination.

2. Description of Related Arts

A conventional light source, such as a conventional head light, usually comprises a main housing, a lighting arrangement received in the main housing, and an attachment strip extended from the main housing to attach onto a head of the user of the conventional head light. The lighting arrangement usually comprises at least one high intensity light bulb or LED for generating light in the direction of the user's face. Thus, the user is able to wear the head light on his or her head and acquire the desired illumination while performing other activities.

However, the head light mounted on the attachment strip can not be detached as other uses such as using as a lamp apparatus, and the light intensity is fixed. Thus, the light head has very limited functions. The illuminating area of the light head is fixed, wherein the light source of the light head such as the bulb only provides a signal light effect, such that a user have no chooses for selecting different light effect regarding their working purpose or environment.

SUMMARY OF THE PRESENT INVENTION

A main object of the present invention is to provide a LED utility light, wherein the LED utility light has different light effects.

Another object of the present invention is to provide a LED utility light for adjusting the light intensities.

Another object of the present invention is to provide a LED utility light, wherein the LED utility light comprises a light head and a light head carrier detachably coupling with the light head to enhance the portability of the LED utility light.

Another object of the present invention is to provide a LED utility light, wherein the light head can be detached to incorporate with different light head carrier for different light effects of different purposes.

Another object of the present invention is to provide a LED utility light, wherein the light head is rotatably coupling with the light head carrier, so that the light effects can be selectively adjusted in a rotating manner.

Another object of the present invention is to provide a LED utility light, wherein the light head carrier comprises a light frame detachably coupling and aligning with the light head, wherein the light head is capable of being rotated to select the light source being emitting from the light frame, so as to select the light effect for illuminating a relatively larger area.

Another object of the present invention is to provide a LED utility light, wherein the light head of the LED utility light is detachably coupling with a head band for attaching the light head onto a head of the user in a hand-free manner.

Another object of the present invention is to provide a LED utility light, wherein the light head of the LED utility light is used as a lamp apparatus to illuminate the surroundings.

Accordingly, in order to accomplish the above objects, the LED utility light of the present invention comprises a light head, which comprises:

a light housing having two sidewalls, a peripheral wall extended between the sidewalls, and at least one light window provided at the peripheral wall;

a power source supported within the light housing;

a LED light arrangement, which is supported within the light housing, comprising at least a LED, and aligning with the light window; and a light head carrier detachably coupling with the light head for enhancing a portability of the light head in a hand-free manner, wherein the light head carrier comprises two spaced apart retention walls rotatably coupling with the sidewalls of the light housing in such a manner that the light housing is adapted to be rotated to selectively adjust a position the light window at a forward direction for illumination and to selectively adjust a projecting angle of the light source.

These and other objectives, features, and advantages of the present invention will become apparent from the following detailed description, the accompanying drawings, and the appended claims.

DETAILED DESCRIPTION OF THE PREFERRED EMBODIMENT

Figure 1:
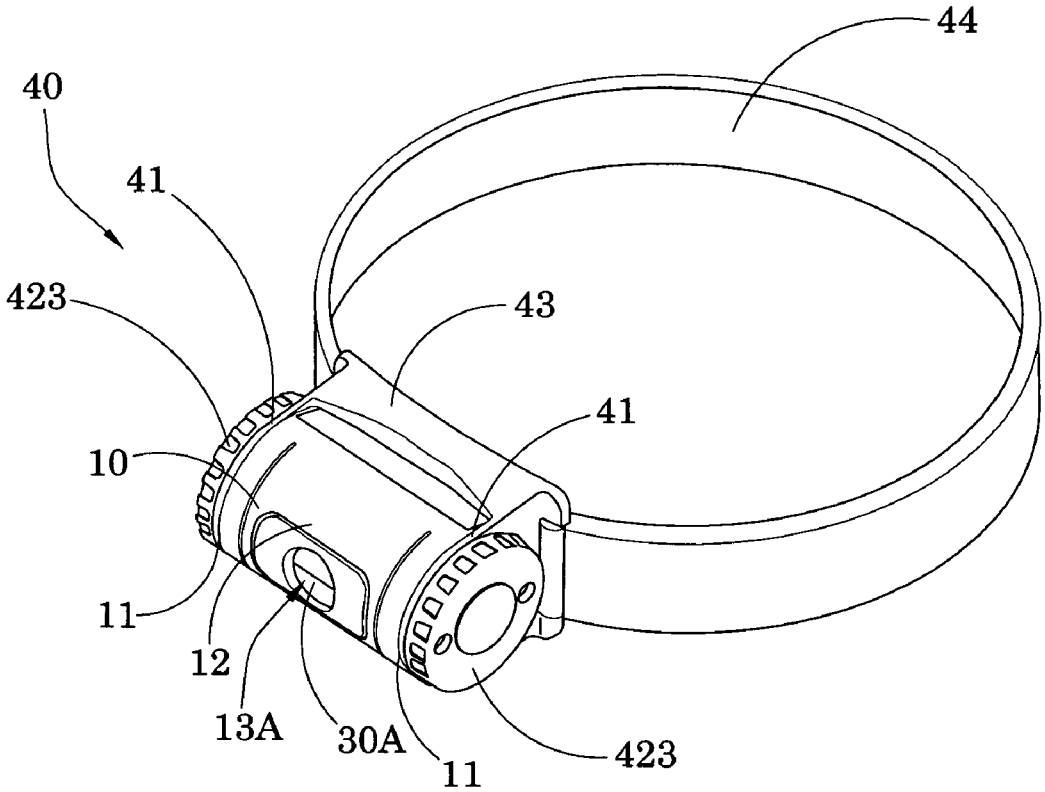
FIG. 1 is a perspective view of a LED utility light according to a preferred embodiment of the present invention, illustrating the first light window of the light housing.

Referring to FIGS. 1 to 8 of the drawings, a LED utility light of a preferred embodiment of the present invention is illustrated, wherein the LED utility light comprises a light head and a light head carrier 40. The light head comprises a light housing 10, a power source 20, and a LED light arrangement.

The light housing 10 has two sidewalls 11, a peripheral wall 12 extended between the sidewalls 11, and a plurality of light windows 13A, 13B, 13C spacedly provided at the peripheral wall 12. The power source 20 is supported within the light housing 10.

The LED light arrangement, which is supported within the light housing 10, comprises a plurality of light sources 30A, 30B, 30C, having different light intensities, aligning with the light windows 13A, 13B, 13C respectively.

The light head carrier 40 is detachably coupling with the light head for enhancing a portability of the light head in a hand-free manner, wherein the light head carrier 40 comprises two spaced apart retention walls 41 rotatably coupling with the sidewalls 11 of the light housing 10 in such a manner that the light housing 10 is adapted to be rotated to selectively adjust one of the light windows 13A, 13B, 13C at a forward direction so as to select the light intensity of the corresponding light source 30A, 30B, 30C for illumination.

It is worth to mention that the light housing 10 has a tubular shape provided for coupling the two sidewalls 12 of the light housing 10 with the two retention walls 41 of the light head carrier 40 in a rotatably adjustable manner to select the light intensities, so that the tubular shape light housing 10 is to be smoothly rotated to selectively adjust one of the light windows 13A, 13B, 13C as the user desired.

Figure 7:
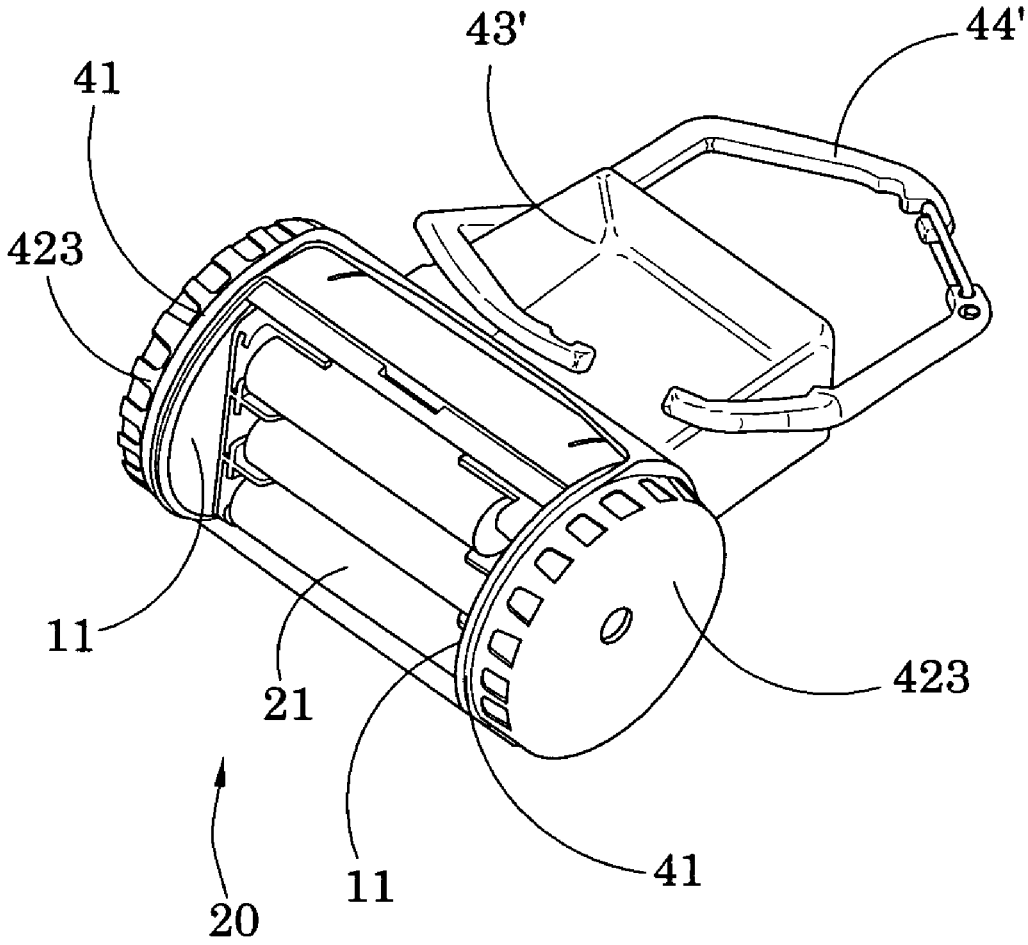
FIG. 7 is a perspective view of the LED utility light according to the above preferred embodiment of the present invention, illustrating the alternative mode of the light head carrier with the power source of the light head.

As shown in FIG. 7 of the drawings, the battery source 20 provided within the light housing 10 of the light head comprises a battery compartment 21 for receiving one or more batteries, and a battery enclosure 22 detachably provided at the peripheral wall 12 of the light housing 10 as a part of the peripheral wall 12 to enclosure the battery compartment 21, such that the light housing 10 is rotated until the battery enclosure 22 is facing forward for replacing the batteries in the battery compartment 21. The battery source 20 is electrically connected to the light source 30A, 30B, 30C of the light arrangement respectively, so that the batteries provide the power to the light sources 30A, 30B, and 30C of the light arrangement for generating the light to illuminate the surroundings, and the light sources 30A, 30B, 30C are individually operated in a controllable manner.

Figure 2:
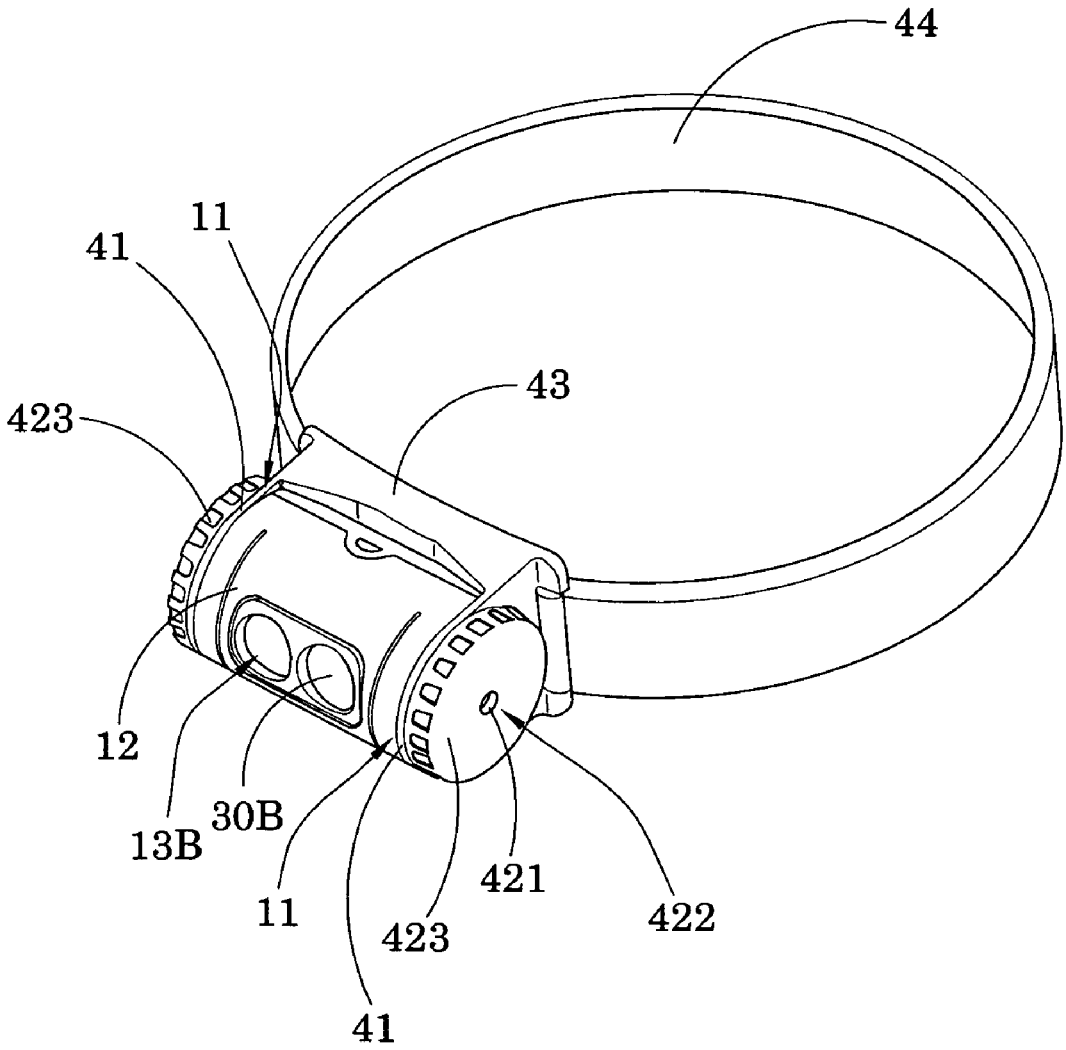
FIG. 2 is a perspective view of the LED utility light according to the above preferred embodiment of the present invention, illustrating the second light window of the light housing.
Figure 3:
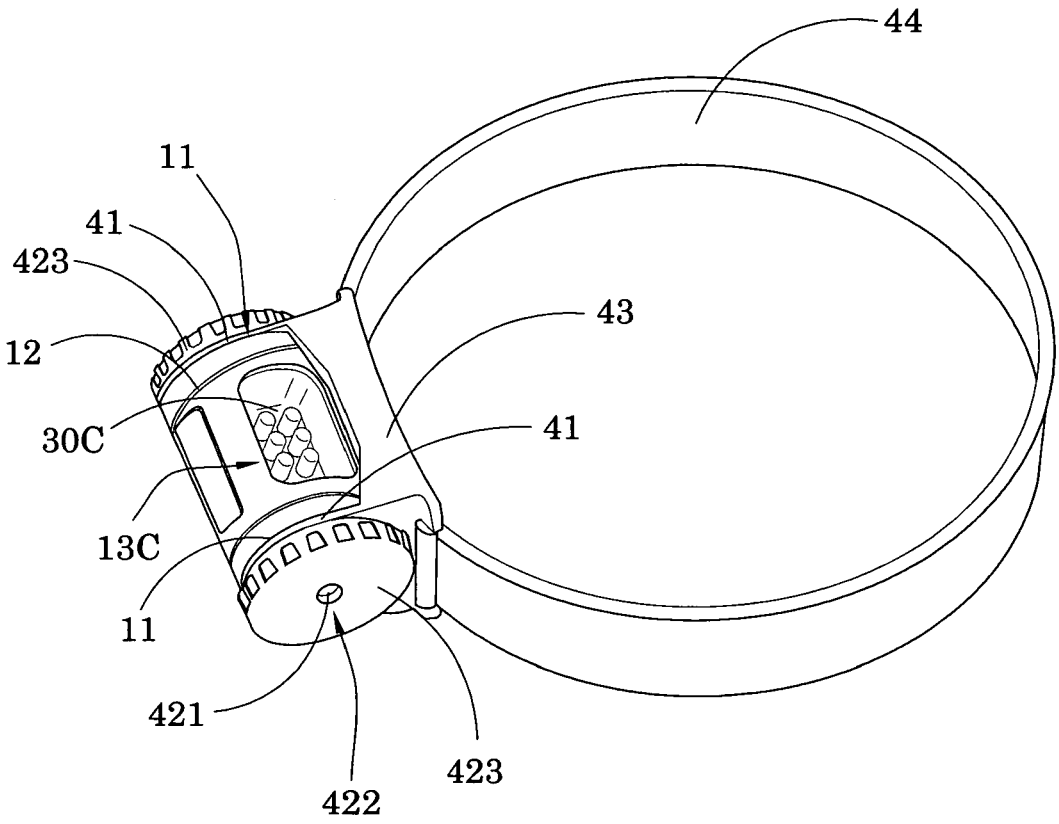
FIG. 3 is a perspective view of the LED utility light according to the above preferred embodiment of the present invention, illustrating the third light window of the light housing.
Figure 4:
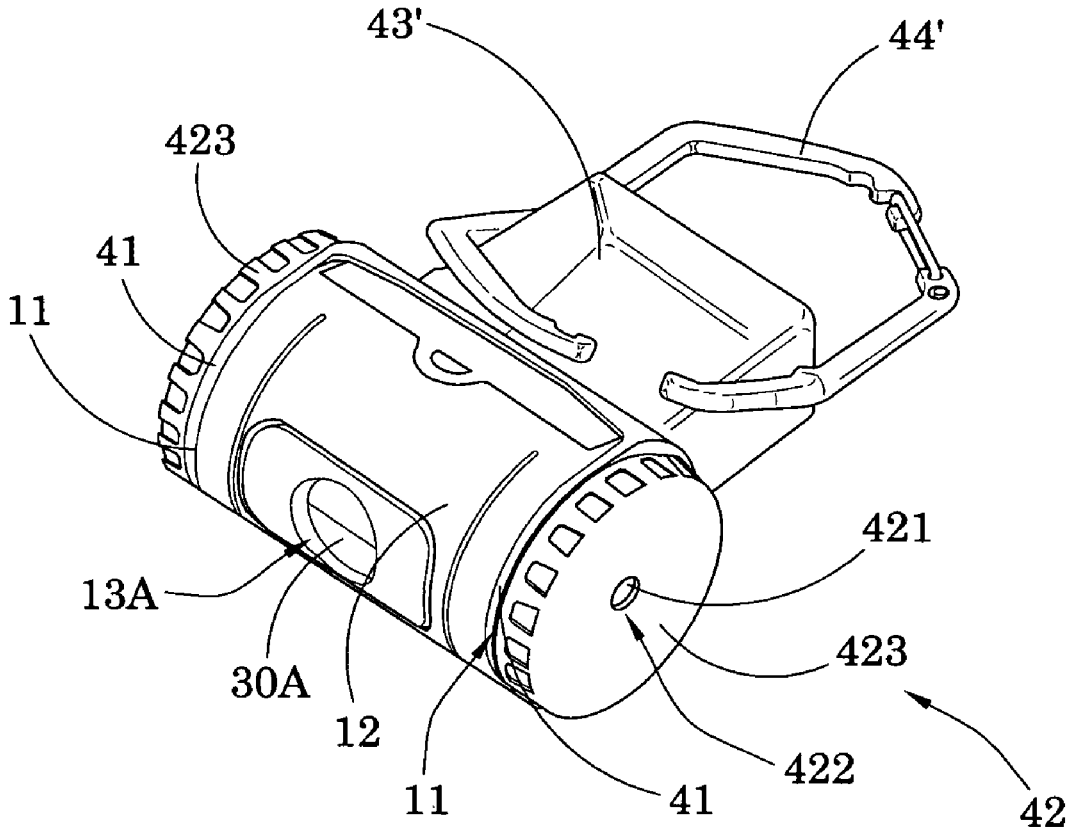
FIG. 4 is a perspective view of the LED utility light according to the above preferred embodiment of the present invention, illustrating the alternative mode of the light head carrier with the first light window of the light housing.
Figure 5:
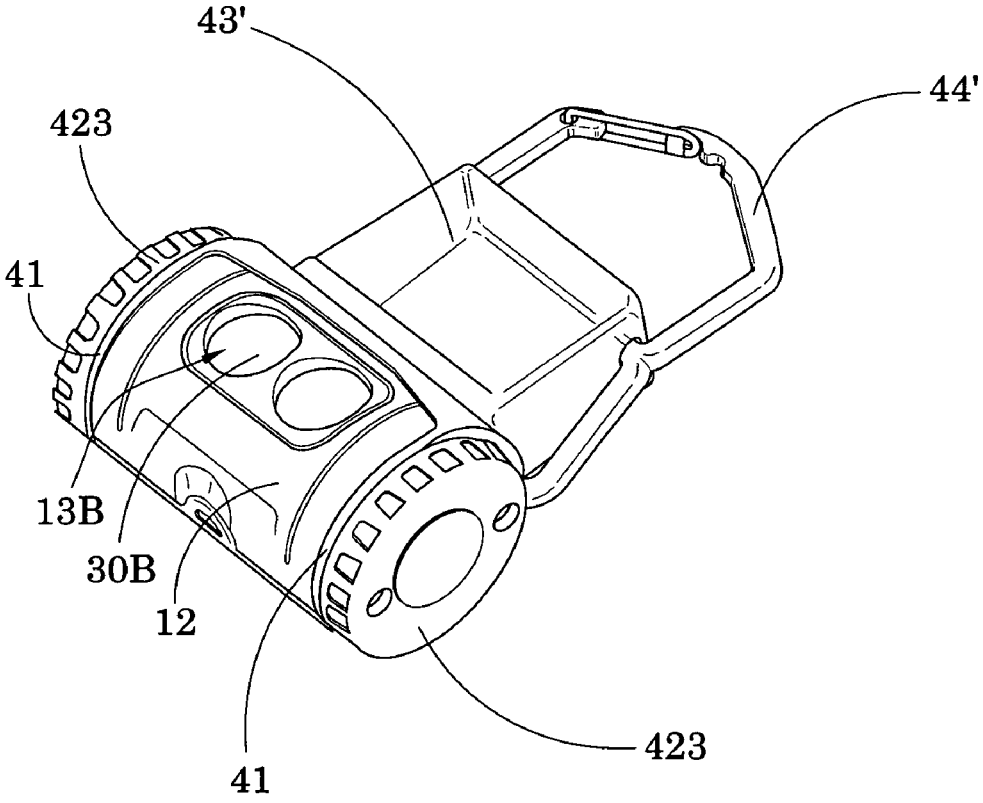
FIG. 5 is a perspective view of the LED utility light according to the above preferred embodiment of the present invention, illustrating the alternative mode of the light head carrier with the second light window of the light housing.
Figure 6:
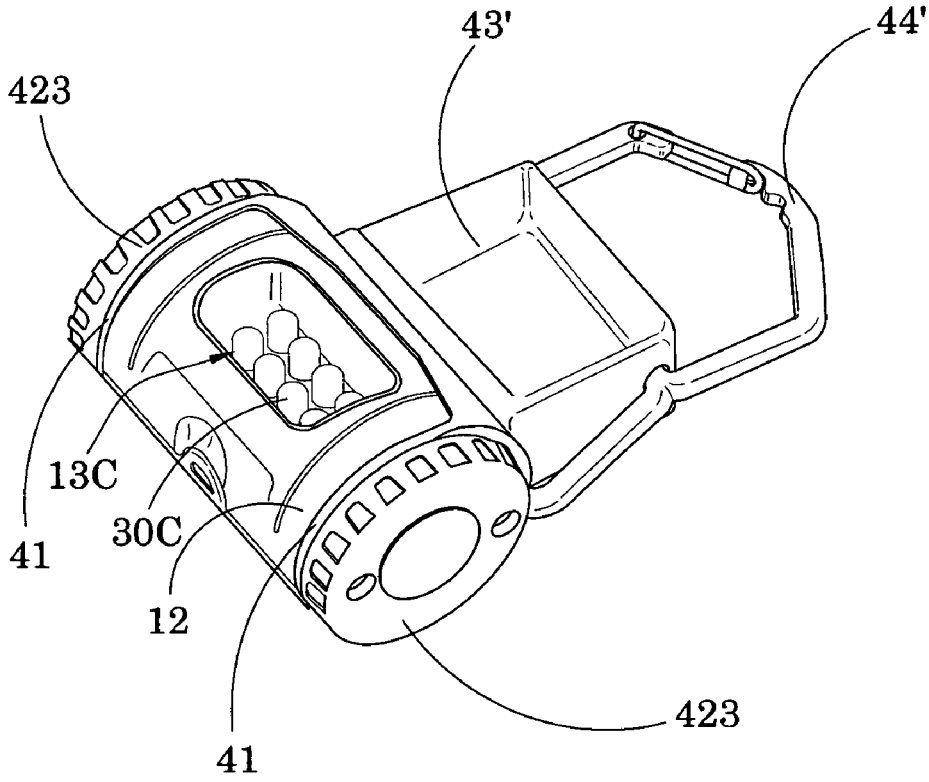
FIG. 6 is a perspective view of the LED utility light according to the above preferred embodiment of the present invention, illustrating the alternative mode of the light head carrier with the third light window of the light housing.

As shown in FIG. 2, the light head carrier 40 further comprises two rotatable lockers 42 detachably and rotatably coupling the sidewalls 11 of the light housing 10 with the retention walls 41 respectively, wherein each of the rotatable lockers 42 comprises a rotatable shaft 421 coaxially and outwardly protruded from the two side walls 11 of the light housing 10 respectively. Two through holes 422 of the rotatable locker 42 are coaxially provided at the two retention walls 41 respectively, wherein the rotatable shaft 421 is coaxially and outwardly extending through the two through holes 422 of the rotatable locker 42. Each of the rotatable lockers 42 further comprises a locker panel 423 detachably locking up the rotatable shaft 421 at a position that the retention wall 41 is sandwiched between the locker panel 423 and the sidewall 11 of the light housing 10, in such manner that the light housing 10 is rotatably coupling with the light head carrier 40 through the rotatable locker 42.

The light head carrier 40 further comprises a base panel 43 extended between two retention walls 41 of the light head carrier 40 to form a U-shaped member to rotatably couple with the light housing 10, and a head band 44 detachably coupling with the base panel 43 for attaching the light head onto the head of the user, in such a manner that the portability of the light head is enhanced by carrying the light head in front of a forehead of the user, so as to conveniently and frontwardly to focus the light on an object as a view of the user.

It is worth to mention that the head band 44 of the light head carrier 40 can be detachably coupling at a peripheral of a hamlet, so that when the user has to wear the hamlet for a safety purpose in a dark working environment, the LED utility light can incorporate with the hamlet in a hand-free manner.

Figure 8:
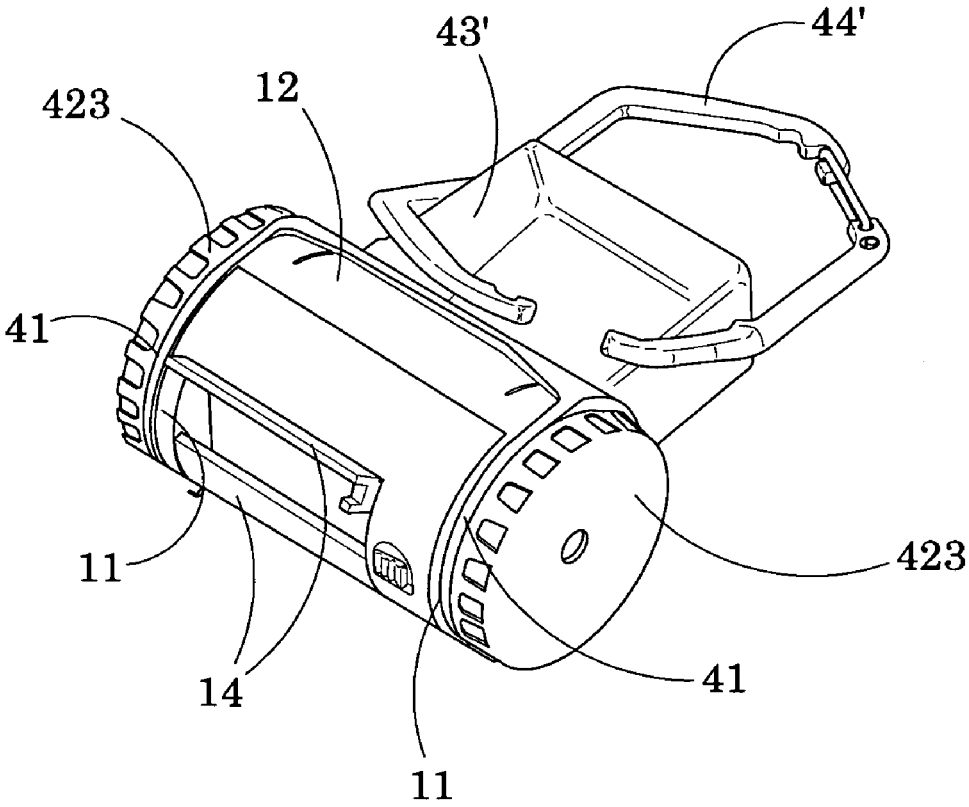
FIG. 8 is a perspective view of the LED utility light according to the above preferred embodiment of the present invention, illustrating the alternative mode of the light head carrier with the flipping stand.
Figure 9:
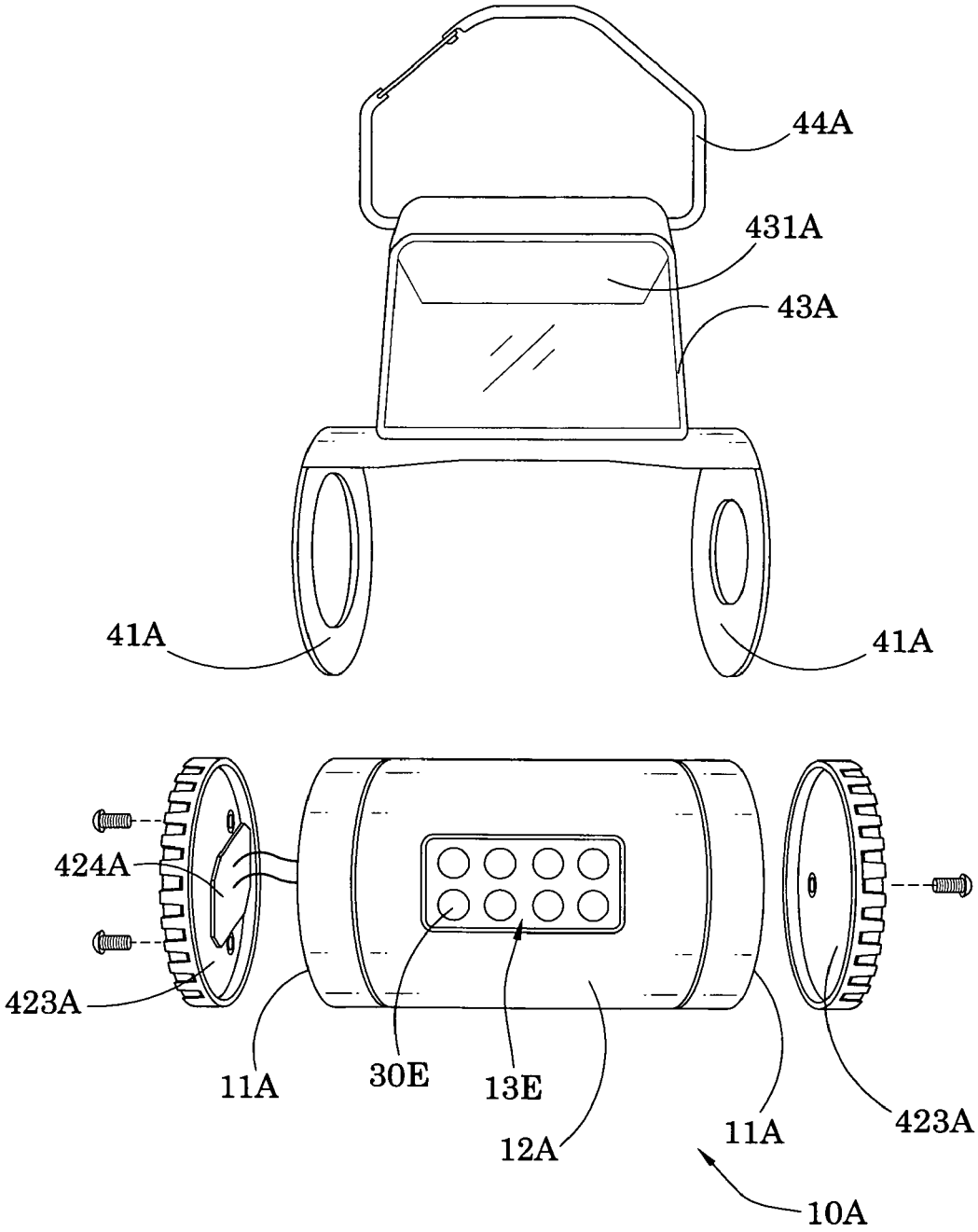
FIG. 9 is an exploded perspective view of the LED utility light according to a second preferred embodiment of the present invention.

As shown in FIG. 8 of the drawings, the light housing 10 further comprises a flipping stand 14 pivotally coupled at the peripheral wall 12 of the light housing 10, wherein the flipping stand 14 is pivotally folded to the peripheral wall 12 to form as a part of the peripheral wall 12 of the light housing 10, wherein the flipping stand 14 is pivotally folded out from the peripheral wall 12 of the light housing 10 for stably supporting the light housing 10 of the light head on a ground surface when the light head is detached from the light head carrier 40, so that the light head can be used as a lamp standing on the ground surface for multiple purposes, such as illuminating a room or a chamber.

Referring to FIG. 4 to FIG. 8 of the drawings, an alternative light head carrier 40 of the LED utility light according to the above preferred embodiment of the present invention is illustrated, wherein the light head carrier 40 comprises a light frame 43' extended between two retention walls 41 to rotatably couple with the light housing 10, and a light stand 44' adjustably and detachably coupling with the light frame 43' in such a manner that when the light housing 10 is rotated at a position that one of the light windows 13A, 13B, 13C is aligned with the light frame 43', so that light from the light sources 30A, 30B, 30C is projected respectively toward the light frame 43' to form a lap apparatus being supported on a ground surface via the light stand 44'.

The light frame 43' is made of light transmissible material for the light generated by the light sources 30A, 30B, 30C to eliminate out from the light frame 43', wherein the light frame 43' has a approximately rectangular shape for coupling and aligning with the light windows 13A, 13B, 13C of the light housing 10, and for eliminating the light projected from the light sources 30A, 30B, 30C through the light windows 13A, 13B, 13C to illuminate a relatively larger area. The flipping stand 14 is flipped to fold out from the peripheral wall 12 of the light housing 10 for supporting the light housing 10 on the ground surface, such that the lamp apparatus is securely and stably standing on the ground surface for illuminating purpose.

The light stand 44' of the light head carrier 40 has a long tubular shape having a first end and a second end, wherein the light stand 44' is folded to coupling with two side edges of the light frame 43' through the first end and the second end of the light stand 44' respectively, so that the light stand 44' is connecting with the ground surface to support the light frame 43'. It is worth mentioning that the light stand 44' coupling with the light frame 43' can be used as a hook for suspending and hanging the light head on a wall or the likes.

Accordingly, the light head of the LED utility light of the present invention is detachably detached for using in different purpose such as using as a head light for carrying onto the head of the user and focusing the light on the object as the view of the user, or the lamp apparatus for illuminating the entire room. Furthermore, the adjustable light intensities adjusted by selecting the light windows 13A, 13B, 13C which is aligned with the light sources 30A, 30B, 30C give the user more selections to adjust the light intensities in different environment as the user desired. In other words, when the light housing 10 is rotated at different positions, the LED utility light of the present invention will provide different light effect, such as the spot light for illuminating a specific area, or the lamp for illuminating the entire working room or chamber.

Referring to FIG. 9 to 12 of the drawings, a LED utility light of a second preferred embodiment of the present invention is illustrated, wherein the LED utility light comprises a light head and a light head carrier. The light head comprises a light housing 10A, a power source 20A, and a LED light arrangement.

The light housing 10A has two sidewalls 11A, a peripheral wall 12A extended between the sidewalls 11A, and at least one light window 13E provided at the peripheral wall 12A. The power source 20A is supported within the light housing 10A.

The LED light arrangement, which is supported within the light housing 10A, comprises at least one light source 30E aligning with the light window 13E.

Figure 11A:
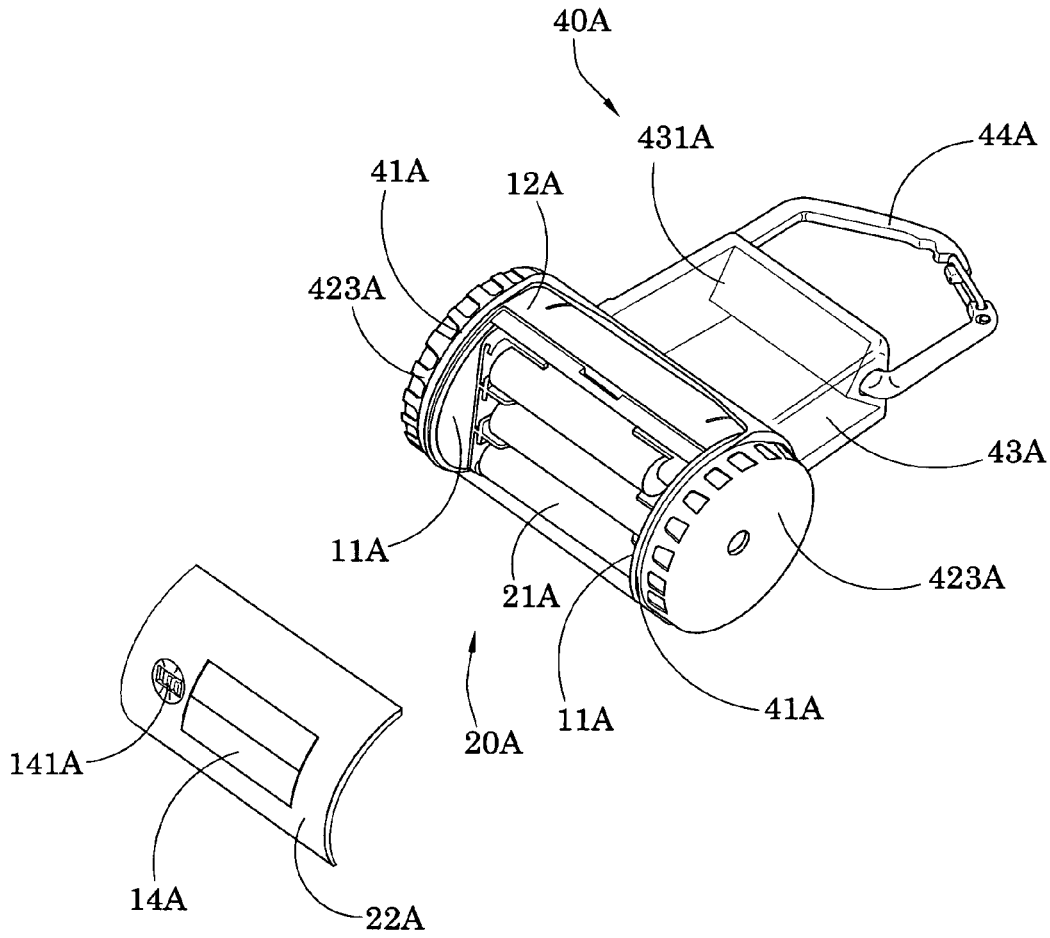
FIG. 11A is a perspective view of the power source of the LED utility light according to the second preferred embodiment of the present invention, illustrating the battery compartment and the battery enclosure detached from the battery compartment.

As shown in FIG. 11A of the drawings, the battery source 20A provided within the light housing 10A of the light head comprises a battery compartment 21A for receiving one or more batteries, and a battery enclosure 22A detachably provided at the peripheral wall 12A of the light housing 10A as a part of the peripheral wall 12A to enclosure the battery compartment 21A, such that the light housing 10A is rotated until the battery enclosure 22A is facing forward for replacing the batteries in the battery compartment 21A. The battery source 20A is electrically connected to the light source 30E of the light arrangement, so that the batteries provide the power to the light source 30E of the light arrangement for generating the light to illuminate the surroundings, and the light sources 30E is operated in a controllable manner.

The light head carrier 40A is detachably coupling with the light head for enhancing a portability of the light head in a hand-free manner, wherein the light head carrier 40A comprises two spaced apart retention walls 41A rotatably coupling with the sidewalls 11A of the light housing 10A in such a manner that the light housing 10A is adapted to be rotated to selectively adjust the light window 13E at a forward direction so as to select the light effects of the light source 30E for illumination. In addition, the light housing 10A is adapted to be rotated to selectively adjust a projecting angle of the light source 30E as well.

The light head carrier 40A comprises two rotatable lockers 42A detachably and rotatably coupling with the sidewalls 11A of the light housing 10A with the retention walls 41A respectively, wherein each of the rotatable lockers 42A comprises a locker panel 432A detachably locking at the respective retention wall 41A at a position that the retention wall 41A is sandwiched between the locker panel 423A and the sidewall 11A of the light housing 10A, in such manner that the light housing 10A is rotatably coupling with the light head carrier 40A through the rotatable locker 42A.

The light head carrier 40A further comprises a light frame 43A extended between two retention walls 41A of the light head carrier 40A to form a U-shaped member to rotatably couple with the light housing 10A, and a light hanger 44A adjustably and detachably coupling with the light frame 43A in such a manner that when the light housing 10A is rotated at a position that the light window 13E is aligned with the light frame 43A, the light from the light source 30E is projected toward the light frame 43A to form a lamp apparatus. In addition, the lamp apparatus can be suspendedly hung via the light hanger 44A. Alternatively, when the light housing 10A is rotated at a position that the light window 13E is moved away from the light frame 43A, the light from the light source 30E directly projects out of the light window 13E to form a spot light.

The light frame 43A is made of light transmissible material for the light generated by the light source 30E to diffusely emit out from the light frame 43A, wherein the light frame 43A has an opening having a size and shape geographically matching the light window 13E for aligning with the light window 13E, so as to emit the light beam from the light source 30E through the light frame 43A. The light frame 43A has an approximately rectangular shape for coupling and aligning with the light window 13E of the light housing 10A, and for emitting the light projected from the light source 30E through the light window 13E to illuminate a relatively larger area.

In order to enhance the light intensity and efficiently emitting the light beam generated from the light source 30E out of the light frame 43A, a reflection member 431A is provided at a ceiling of the light frame 43A to align with the light window 13E, wherein the reflection member 431A has a triangular cross section for scattering the light beam to enhance the light intensity through the light frame 43A, and mounted within the light frame 43A on an opposite side of the light frame opening, so that when the light beam is projected from the light window 13E to the reflection member 431A, the light beam is capable of being scattered to illuminate relatively larger area through the light frame 43A.

It is worth to mention that the light frame 43A is integrally extended from the retention wall 41A such that the light frame 43A can be detached from the light housing 10A via the two rotatable lockers 42A by detaching the retention wall 41A from the light housing 10A.

Figure 10:
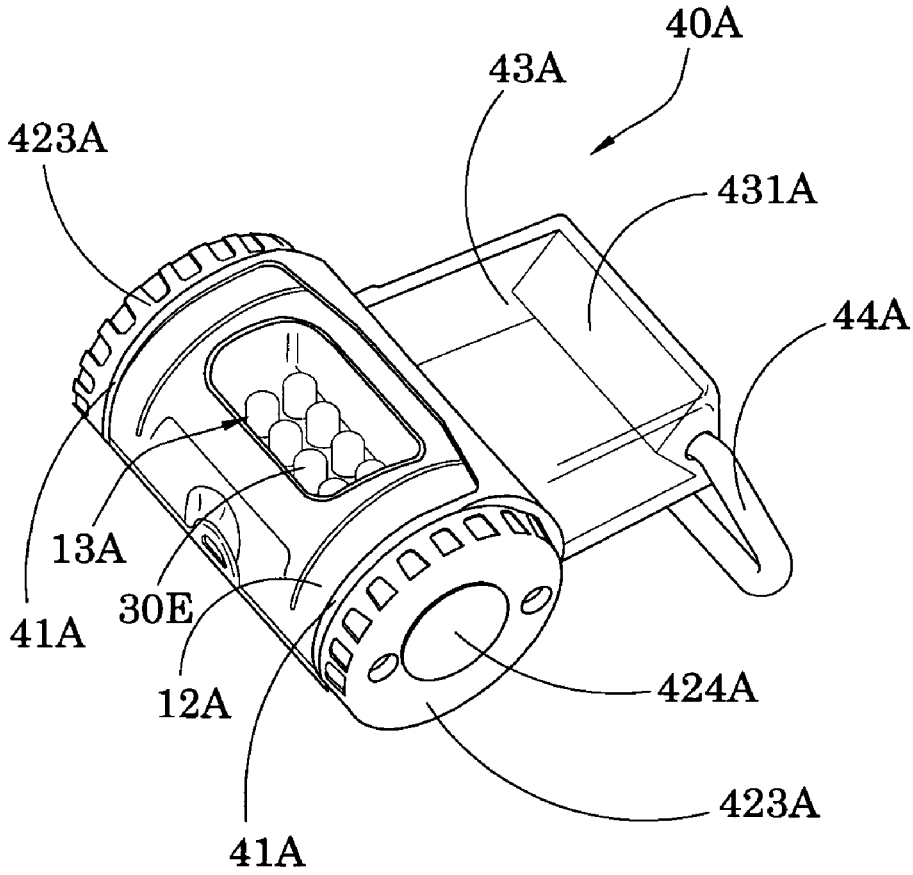
FIG. 10 is a perspective view of the LED utility light according to the second preferred embodiment of the present invention.

Accordingly, the light source 30E of the light head comprises at least one LED electrically connected to the power source 20A for generating a spot light for illuminating and focusing on a specific working area. Thus, the light head is capable of rotatably adjusting the light housing 10A of the light head to select different light effects. When the light window 13E is rotatably align with the light frame 43A, the light beam generated from the light source 30E is being emitted from the light frame 43A to light up a general bigger area. Conversely, when the light window 13E is forwardly rotated away from the light frame 43A, the light beam generated from the LED of the light source 30E is emitted as the spot light to illuminate a relatively smaller area and stronger light intensity, as shown in FIG. 10.

It is worth to mention that the light housing 10A has a tubular shape provided for coupling the two sidewalls 11A of the light housing 10A with the two retention walls 41 of the light head carrier 40A in a rotatably adjustable manner to select the light effects, so that the tubular shape light housing 10A is to be smoothly rotated to selectively adjust one of the light effects as the user desired.

The light housing 10A further comprises a flipping stand 14A pivotally coupled at the peripheral wall 12A of the light housing 10, and more specifically at an outer side of the battery enclosure 22A, wherein the flipping stand 14A is pivotally folded to the peripheral wall 12A to form as a part of the peripheral wall 12A of the light housing 10A, wherein the flipping stand 14A is pivotally folded out from the peripheral wall 12A of the light housing 10A for stably supporting the light housing 10A of the light head on a surface, so that the light head can be used as a lamp standing on the surface for multiple purposes, such as illuminating a room or a chamber. It is worth to mention that the flipping stand 14A comprises two flipping legs pivotally coupling at the battery enclosure 22A, wherein the flipping legs are pivotally folded towards each other to form the part of the peripheral wall 12A of the light housing 10A and are pivotally and outwardly folded away from each other to form a lamp stand. In addition, the flipping stand 14A is located opposite to the light window 13E.

Figure 11B:
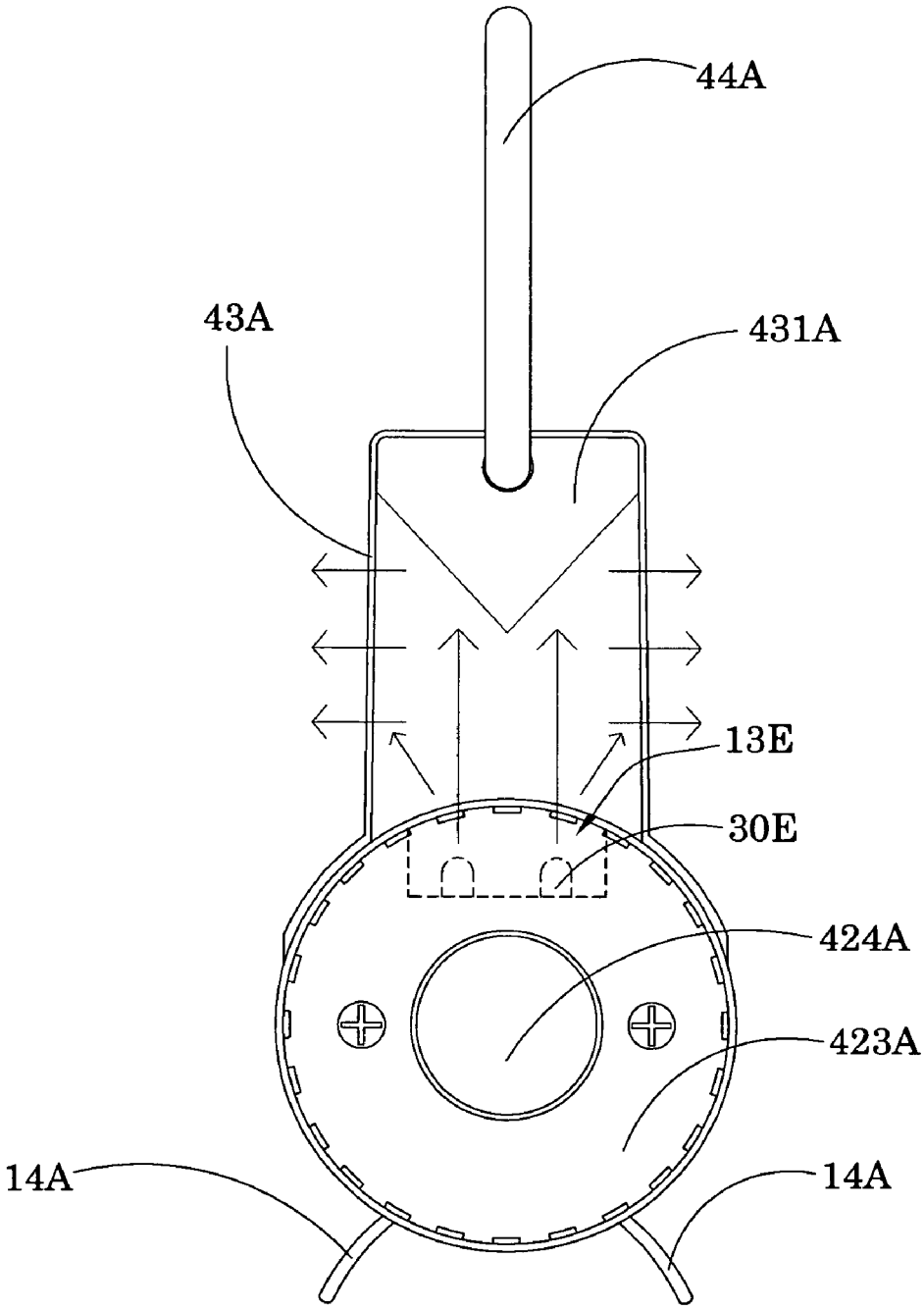
FIG. 11B is a side view of the LED utility light according to the second preferred embodiment of the present invention, illustrating the flipping stand provided on the outer surface of the battery enclosure being outwardly flipped.

As shown in FIGS. 11A and 11B, the battery enclosure 22A coupled with the peripheral wall 12A as a part of the peripheral wall 12A of the light housing 10A, has a flipping switch 141A provided on the outer surface of the battery enclosure 22A, wherein the flipping switch 141A is adapted for outwardly flipping the flipping stand 14A to support the light head thereon.

Figure 12:
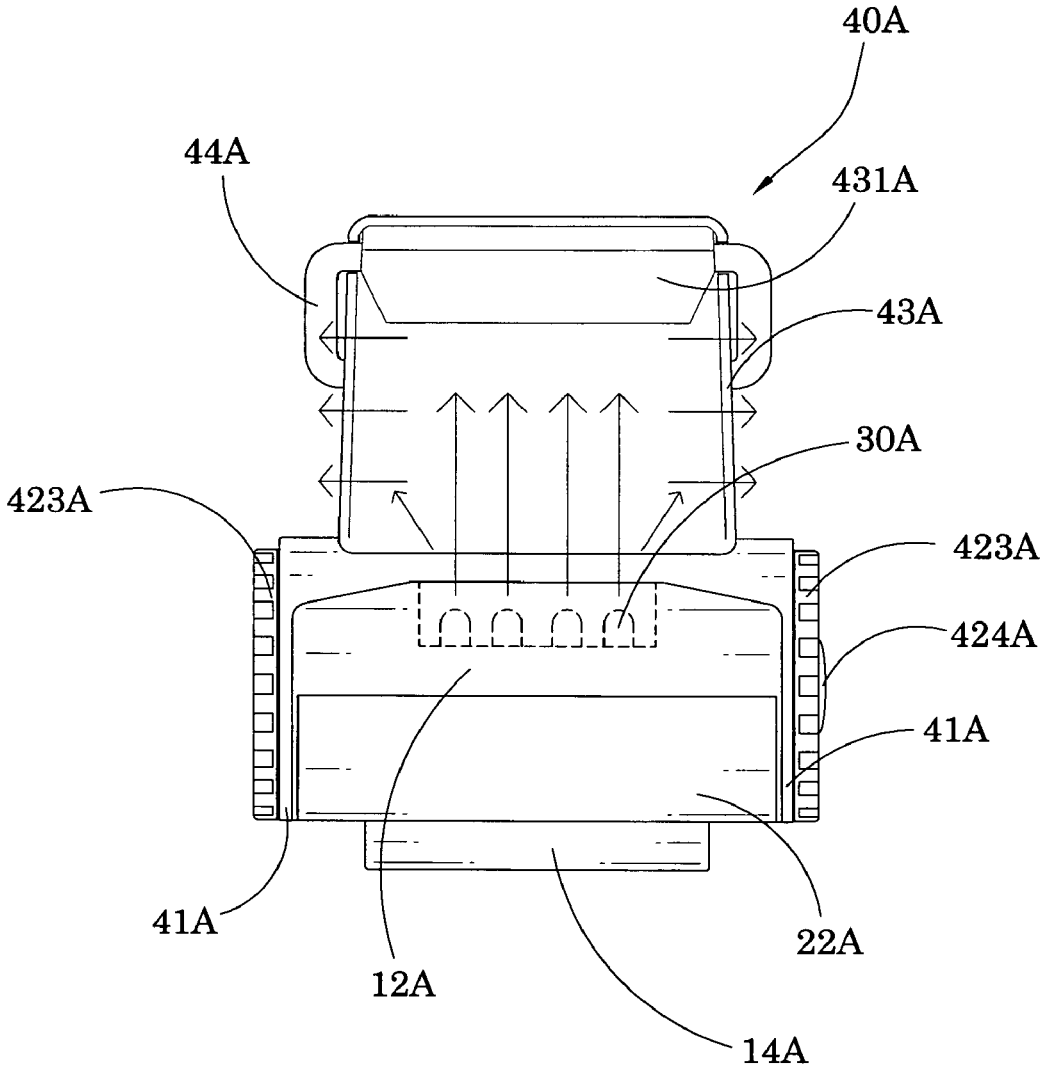
FIG. 12 is a side view of the LED utility light according to the second preferred embodiment of the present invention, illustrating the light head standing on a surface via the flipping stand.

The flipping stand 14A is flipped to fold out from the peripheral wall 12A of the light housing 10A for supporting the light housing 10A on the surface, such that the lamp apparatus is securely and stably standing on the surface for illuminating purpose. It is appreciated that the battery enclosure 22A is provided at an opposite side of the light window 13E at the peripheral wall 12A of the light housing 10A, so that the light source 30E is provided on the opposite side of the flipping stand 14A, so as to be supported by the flipping stand 14A to outwardly illuminate the environment, as shown in FIG. 12.

Figure 13:
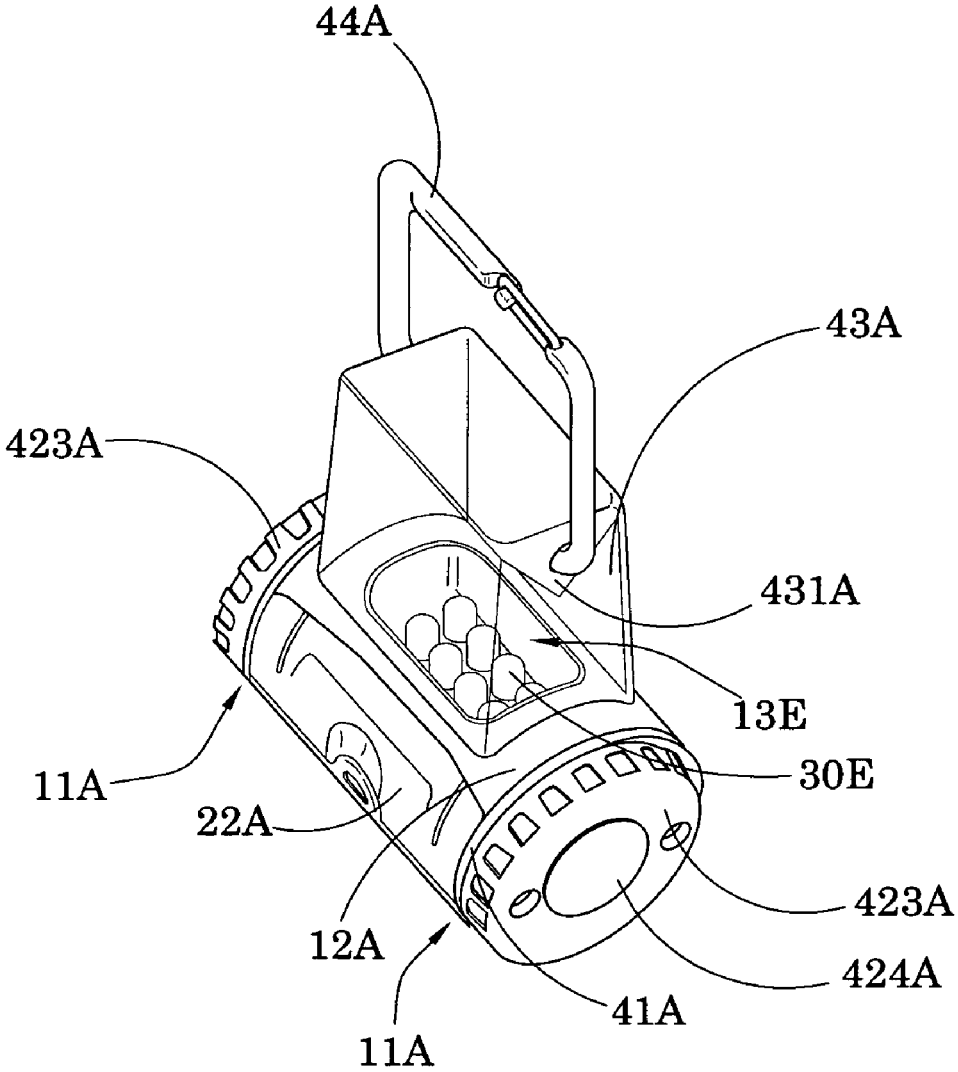
FIG. 13 is a perspective view of the LED utility light according to the second preferred embodiment of the present invention, illustrating the light head being suspended via the light hanger.

The light hanger 44A of the light head carrier 40A has a long tubular shape having a first end and a second end, wherein the light hanger 44A is folded to coupling with two side edges of the light frame 43A through the first end and the second end of the light stand 44A respectively. It is worth mentioning that the light stand 44A coupling with the light frame 43A can be used as a hook for suspending and hanging the light head on a wall, ceiling or the likes, so as to be used as another light effect of overhead lamp, as shown in FIG. 13.

An actuation button 424A is further provided on one of the outer surface of the locker panel 423A of rotatable locker 42A, wherein the actuation button 424A is adapted for switching the light source 30E by pressing the actuation button 424A in an on-and-off manner.

Figure 14:
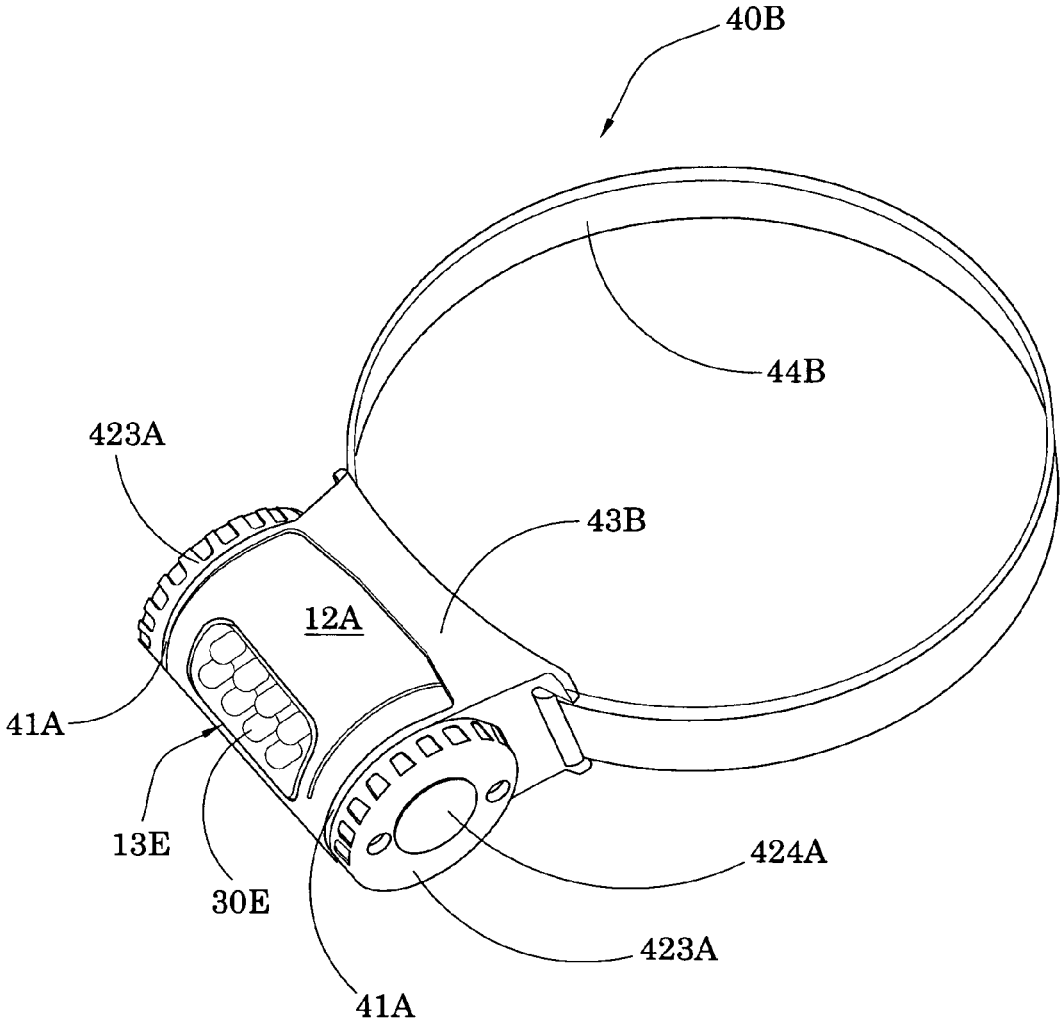
FIG. 14 is a perspective view of the LED utility light according to an alternative light head carrier of the second preferred embodiment of the present invention.

Referring to FIG. 14, an alternative light head carrier according to the second preferred embodiment of the present invention is illustrated, wherein the light head carrier 40B is detachably coupling with the light head for enhancing a portability of the light head in a hand-free manner, wherein the light head carrier 40B comprises two spaced apart retention walls 41A rotatably coupling with the sidewalls 11A of the light housing 10A in such a manner that the light housing 10A is adapted to be rotated to selectively adjust the light window 13E projecting direction so as to select the light effects of the light source 30E for illumination.

The light head carrier 40B comprises two rotatable lockers 42A detachably and rotatably coupling with the sidewalls 11A of the light housing 10A with the retention walls 41A respectively, wherein each of the rotatable lockers 42A comprises a locker panel 432A detachably locking at the respective retention wall 41A at a position that the retention wall 41A is sandwiched between the locker panel 423A and the sidewall 11A of the light housing 10A, in such manner that the light housing 10A is rotatably coupling with the light head carrier 40A through the rotatable locker 42A.

The light head carrier 40B further comprises a base panel 43B extended between two retention walls 41A of the light head carrier 40B to form a U-shaped member to rotatably couple with the light housing 10A, and a head band 44B detachably coupling with the base panel 43B for attaching the light head onto the head of the user, in such a manner that the portability of the light head is enhanced by wearing the light head in front of a forehead of the user, so as to conveniently and frontwardly to focus the light on an object as a view of the user. It is worth to mention that the head band 44B of the light head carrier 40B can be detachably coupling at a peripheral of a hamlet, so that when the user has to wear the hamlet for a safety purpose in a dark working environment, the LED utility light can incorporate with the hamlet in a hand-free manner.

It is worth to mention that the base panel 43B is integrally extended from the retention wall 41A such that the head band 44B can be detached from the light housing 10A via the two rotatable lockers 42A by detaching the retention wall 41A from the light housing 10A.

It is worth to mention that the light head carrier 40A and the light head carrier 40B are interchangeable that the user is able to detachably attach the light head carrier 40A to the light head to form the lamp apparatus by rotating the light window 13E to align with the light frame 43A or to form the spot light apparatus by rotating the light window 13E away from the light frame 43A. Moreover, the user is able to detachably wear the light head carrier 40B to support the light head at the forehead of the user so as to form a hand-free spot light by mounting the light head carrier 40B at the head of the user.

It is appreciated that the light source 30E can be interchanged with one of the light sources 30A, 30B, 30C to provide different light intensities.

Accordingly, the light head of the LED utility light of the present invention is detachably detached for using in different purpose such as using as a head light for carrying onto the head of the user and focusing the light on the object as the view of the user, or the lamp apparatus for illuminating relatively larger area, so as to select the different light effects as the user desired.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A LED utility light, comprising:

a light head, which comprises:

a light housing having two sidewalls, a peripheral wall extended between said sidewalls, and at least a light window provided at said peripheral wall;

a power source supported within said light housing; and a LED light arrangement, which is supported within said light housing, comprising at least a light source aligning with said light window for light generation; and a light head carrier detachably coupling with said light head for enhancing a portability of said light head in a hand-free manner, wherein said light head carrier comprises two spaced apart retention walls detachably and rotatably coupling with said sidewalls of said light housing in such a manner that said light housing is adapted to be rotated to selectively adjust a position said light window at a forward direction for illumination and to selectively adjust a projecting angle of said light source, wherein said light head carrier further comprises a light frame made of light transmissible material extended between two retention walls to rotatably couple with said light housing, wherein when said light housing is rotated to align said light window with said light frame, said light from said light source is diffusely projected toward said light frame to form a lamp apparatus, wherein when said light housing is rotated at a position that said light window is moved away from said light frame, said light from said light source directly projects out of said light window to form a spot light.

2. The LED utility light, as recited in claim 1, wherein said light head carrier further comprises a reflection member provided at a ceiling of said light frame to align with said light window for reflectively scattering said light so as to enhance the light intensity through said light frame.

3. The LED utility light, as recited in claim 1, wherein said light head carrier further comprises a flipping stand pivotally coupled at said peripheral wall of said light housing, wherein said flipping stand is adapted to pivotally fold to said peripheral wall to form as a part of said peripheral wall of said light housing, and to pivotally fold out from said peripheral wall of said light housing for stably supporting said light housing of said light head on a surface.

4. The LED utility light, as recited in claim 2, wherein said light head carrier further comprises a flipping stand pivotally coupled at said peripheral wall of said light housing, wherein said flipping stand is adapted to pivotally fold to said peripheral wall to form as a part of said peripheral wall of said light housing, and to pivotally fold out from said peripheral wall of said light housing for stably supporting said light housing of said light head on a surface.

5. The LED utility light, as recited in claim 1, wherein said light head carrier further comprises a light hanger rotatably coupling at said light frame for said light housing being suspendedly hung.

6. The LED utility light, as recited in claim 4, wherein said light head carrier further comprises a light hanger rotatably coupling at said light frame for said light housing being suspendedly hung.

7. The LED utility light, as recited in claim 4, wherein said flipping stand is located on said peripheral wall of said light housing opposite to said light window thereof.

8. The LED utility light, as recited in claim 6, wherein said flipping stand is located on said peripheral wall of said light housing opposite to said light window thereof.

9. The LED utility light, as recited in claim 4, wherein said power source comprises a battery compartment provided in said light housing for receiving one or more batteries, and a battery enclosure detachably coupled at said peripheral wall of said light housing as a part of said peripheral wall to enclose said battery compartment, such that said light housing is rotated until said battery enclosure is facing forward for replacing said batteries in said battery compartment.

10. The LED utility light, as recited in claim 8, wherein said power source comprises a battery compartment provided in said light housing for receiving one or more batteries, and a battery enclosure detachably coupled at said peripheral wall of said light housing as a part of said peripheral wall to enclose said battery compartment, such that said light housing is rotated until said battery enclosure is facing forward for replacing said batteries in said battery compartment.

11. The LED utility light, as recited in claim 9, wherein said flipping stand is pivotally formed at said battery enclosure.

12. The LED utility light, as recited in claim 10, wherein said flipping stand is pivotally formed at said battery enclosure.

13. The LED utility light, as recited in claim 12, wherein said retention walls are detachably coupled at said sidewalls of said light housing via two rotatable lockers respectively, wherein each of said rotatable lockers comprises a rotatable shaft coaxially and outwardly protruded from said respective sidewall of said light housing, a through hole provided at said respective retention wall for said rotatable shaft extending therethrough, and a locker panel detachably locking up said rotatable shaft at a position that said retention wall is sandwiched between said sidewall of said light housing and said locker panel.

14. A LED utility light, comprising:

a light head, which comprises:

a light housing having two sidewalls, a peripheral wall extended between said sidewalls, and at least a light window provided at said peripheral wall;

a power source supported within said light housing; and a LED light arrangement, which is supported within said light housing, comprising at least a light source aligning with said light window for light generation; and a light head carrier detachably coupling with said light head for enhancing a portability of said light head in a hand-free manner, wherein said light head carrier comprises two spaced apart retention walls detachably and rotatably coupling with said sidewalls of said light housing in such a manner that said light housing is adapted to be rotated to selectively adjust a position said light window at a forward direction for illumination and to selectively adjust a projecting angle of said light source, wherein said light head carrier further comprises a flipping stand pivotally coupled at said peripheral wall of said light housing, wherein said flipping stand is adapted to pivotally fold to said peripheral wall to form as a part of said peripheral wall of said light housing, and to pivotally fold out from said peripheral wall of said light housing for stably supporting said light housing of said light head on a surface.

* * * * *